US012680772B2

(12) United States Patent
Hüroğlu

(10) Patent No.: US 12,680,772 B2
(45) Date of Patent: Jul. 14, 2026

(54) PISTOL WITH GRIP PROTRUSIONS TO PREVENT MAGAZINE SHIFTING

(71) Applicant: HÜRSAV SILAH SANAYI VE TICARET LIMITED ŞIRKETI, Istanbul (TR)

(72) Inventor: Semih Hüroğlu, Istanbul (TR)

( * ) Notice: Subject to any disclaimer, the term of this patent is extended or adjusted under 35 U.S.C. 154(b) by 0 days.

(21) Appl. No.: 19/040,678

(22) Filed: Jan. 29, 2025

(65) Prior Publication Data

US 2025/0257960 A1 Aug. 14, 2025

(30) Foreign Application Priority Data

Feb. 8, 2024 (TR) ..... 2024/001501

(51) Int. Cl.
*F41A 9/38* (2006.01)

(52) U.S. Cl.
CPC ..... *F41A 9/38* (2013.01)

(58) Field of Classification Search
CPC ..... F41A 9/65; F41A 9/38; F41A 9/69; F41A 9/70; F41A 9/71; F41A 9/72; F41A 3/66; F41C 23/10; F41C 23/00; F41C 7/00
USPC ..... 42/7, 50, 16, 18, 49.02
See application file for complete search history.

(56) References Cited

U.S. PATENT DOCUMENTS

| | | | | |
|---|---|---|---|---|
| 5,052,140 | A * | 10/1991 | Smith | F41C 23/10 42/7 |
| 5,566,488 | A * | 10/1996 | Yap | F41A 9/71 42/49.02 |
| 5,906,065 | A * | 5/1999 | Pearce | F41A 9/65 42/50 |
| 7,047,684 | B2 * | 5/2006 | Roh | F41C 23/00 42/16 |
| 10,619,959 | B1 | 4/2020 | Loveday, IV et al. | |
| 2021/0123698 | A1 | 4/2021 | Zeider et al. | |

* cited by examiner

*Primary Examiner* — Michael D David
(74) *Attorney, Agent, or Firm* — EGBERT, MCDANIEL & SWARTZ, PLLC

(57) ABSTRACT

A subcompact-class pistol used in the defense sector, which fires 9 mm caliber bullets, having a trigger lever, trigger, trigger guard, hammer, decocking part, grip, extractor and magazine latch, wherein a rear protrusion and a front protrusion are formed on the inner part of the grip to prevent the magazine from swinging while it is inserted in the body.

2 Claims, 2 Drawing Sheets

PISTOL WITH GRIP PROTRUSIONS TO PREVENT MAGAZINE SHIFTING

CROSS-REFERENCE TO RELATED APPLICATIONS

Not applicable.

FIELD OF THE INVENTION

The invention relates to a subcompact-class pistol used in the defense sector, which fires 9 mm caliber bullets and addresses issues such as jamming and ejection before and after firing.

BACKGROUND OF THE INVENTION

A pistol is a short-barreled firearm. Pistols are referred to as magazine-fed or revolver based on their operating principles and the shape of their bullet storage compartments, and are classified according to the diameter of the bullets used. Pistols are manufactured from hard metal (chrome, nickel, stainless steel) or, more recently, hard plastic. Pistols are divided into three groups: semi-automatic magazine-fed pistols, revolvers (or six-shooters) and single-shot pistols. The biggest advantage of semi-automatic pistols is that they use the recoil from the fired cartridge to eject the empty case, cock the hammer, and load a new bullet. This allows multiple shots to be fired quickly. Unlike revolvers, semi-automatic pistols have only one slot. The bullets are stored in the magazine of the pistol grip. A magazine is an ammunition storage and feeding device that is either in or attached to a repeating firearm. The magazine functions by moving the cartridges therein to a position where they can be fired by the movement of the firearm. The magazine holds up to 15 or more bullets in single or double columns, depending on the type. A detachable magazine is an independent mechanism that can be loaded or unloaded when separated from the main firearm. They are inserted into a magazine well in the firearm's body, typically located beneath the mechanism. When the magazine is empty, it can be detached from the firearm and replaced with another full magazine. This significantly speeds up the reloading process, giving the operator quick access to the ammunition.

In semi-automatic pistols, it is of great importance that the magazine is designed to hold as many bullets as possible. Although loading the optimal number of bullets into the magazine and ensuring proper feeding of these bullets affect the success of the shot, it is also essential to prevent the magazine from moving within the grip as the number of bullets increases. Many studies have been carried out to prevent the magazine from moving within the grip. One of these studies is the invention subject to patent application No. US2021123698. The invention relates to an increased capacity firearm ammunition magazine with a metallic body. The body is dimensioned to replace a (OEM) polymer or polymer over metal single stack magazine. The body has walls with exterior dimensions compatibly matching those of the OEM (Original Equipment Manufacturer) magazine and that are thinner than those of the OEM magazine. The thinner walls allow an at least partially laterally offset arrangement of bullets therein. A longitudinal exterior ridge extends along a forward wall of the body and is configured from the metallic body walls and sized to compensate for forward-to-aft dimensioning difference compared to that of the OEM magazine.

Another study is the invention subject to patent application No. U.S. Pat. No. 10,619,959. The invention relates to a ribless double stack magazine for use with a firearm. The inner walls of an embodiment of the magazine body define a trapezoidal cross section and there are no ribs extending inwardly from any of the inner walls. The magazine body is fabricated from a plastic material that minimizes friction and bulge slightly in response to pressure on bullets from the spring. The thickness of the sidewalls is sufficient to control the bulge and maintain the exterior dimensions of the magazine within the tolerances necessary to properly function in the magazine well of a firearm.

As a result, the need for a subcompact pistol, which eliminates the disadvantages of the present art, and the shortcomings of the existing solutions have made it necessary to make an improvement in the relevant technical field.

SUMMARY OF THE INVENTION

The invention relates to a subcompact-class pistol used in the defense sector, which fires 9 mm caliber bullets and addresses issues such as jamming and ejection before and after firing, which meets the aforementioned requirements, eliminates all disadvantages, and offers additional advantages.

In view of the state of the art, the object of the invention is to eliminate the gap between the magazine and the inner surface of the grip, along with the issues associated with this gap, without altering the magazine surface, by means of the flat protrusions formed in the grip of the developed pistol.

The object of the invention is to ensure that the magazine fits properly into the grip and to eliminate issues such as jamming and ejection by means of the flat protrusions formed on the opposing front and rear parts of the inner surface of the grip.

The structural and characteristic features and all advantages of the invention will be more apparent from the following figures and the detailed description with reference to these figures and therefore the interpretation should be based on these figures and the detailed descriptions.

BRIEF DESCRIPTION OF DRAWINGS

In order to best understand the embodiment of the present invention and its advantages together with the additional elements, it should be interpreted in conjunction with the figures described below.

REFERENCE NUMBERS

Figure 1:
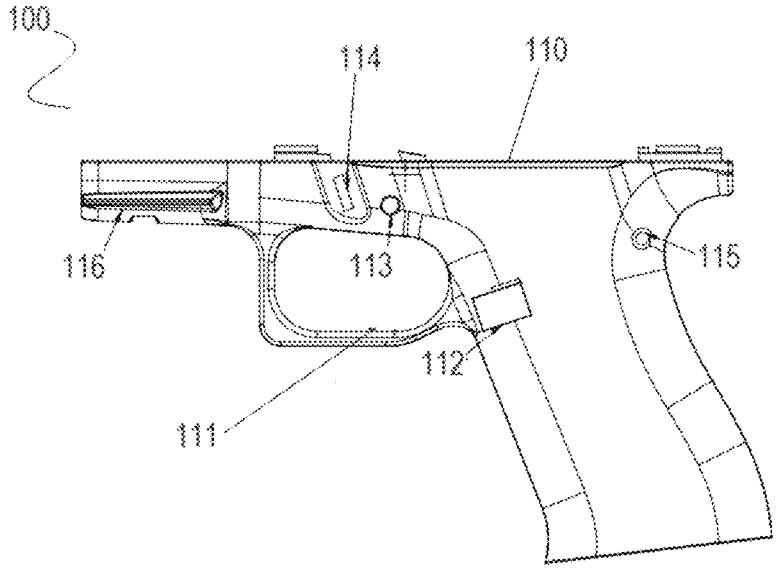
FIG. 1 is a schematic overview of the pistol from the side.

100. Pistol
110. Body
111. Trigger guard
112. Magazine latch slot
113. Trigger pin slot
114. Barrel lock slot
115. Trigger group collector slot
116. Picatinny rail
117. Rear protrusion
118. Front protrusion

DETAILED DESCRIPTION OF THE INVENTION

In this detailed description, the subcompact-class pistol (100) according to the invention, which is used in the defense sector, which fires 9 mm caliber bullets and addresses issues such as jamming and ejection before and after firing, is described only by way of example for a better understanding of the subject matter and without any limiting effect.

The pistol (100) shown in FIG. 1 comprises a body (110) (frame), which is the largest part after disassembly, containing a trigger lever, trigger, trigger guard (111), hammer, decocking part, grip, extractor and magazine latch. A slide, which moves during firing, contains a rear sight, front sight, case ejection port, lug, safety latch, pin and spring; a barrel, which provides direction and orientation to the bullet during firing. A magazine is provided, in which the bullets to be fired are inserted. A recoil spring and recoil rod are provided in order for the slide to return to its original position due to the pressure of the gunpowder gas after the shot. The part of said body (110) that the user holds and into which the magazine is inserted is called the grip. A trigger guard (111) is located just in front of the grip, defining the area where the trigger functions within the body (110) and preventing the trigger from being engaged except by deliberate action. A trigger pin slot (113) is located on the upper part of said trigger guard (111), on the side of the body (110), to allow the trigger to be fixed and operated within the body (110). At the point where the grip and the trigger guard (111) meet, a magazine latch slot (112) is located, where the magazine latch operates and which holds the magazine in the body (110). A picatinny rail (116) is located on the front part of said body (110) for attaching accessories such as flashlights and red dot on the body (110). A barrel lock slot (114) is located between the grip and the picatinny rail (116), on the side of the body (110), in which the barrel lock operates to lock the barrel within the pistol (100). A trigger group collector slot (115) is located on the rear part of the grip facing the user for fixing the trigger group within the body (110).

Figure 2:
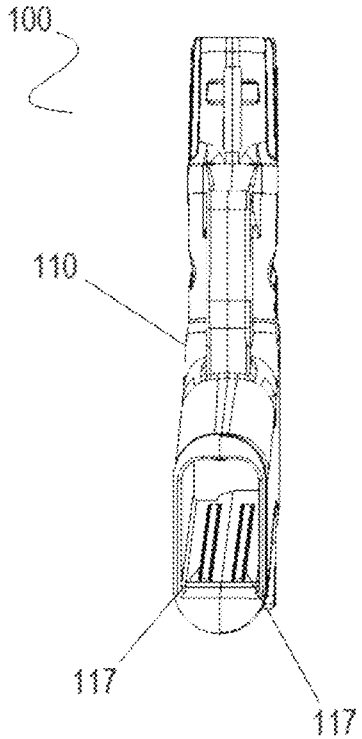
FIG. 2 is a schematic overview of the inside of the grip from the back.
Figure 3:
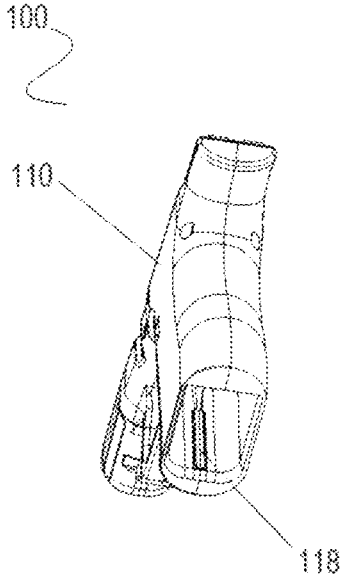
FIG. 3 is a schematic overview of the inside of the grip from the front.

Said pistol (100) is characterized in that it comprises a rear protrusion (117) and a front protrusion (118) formed on the inside of the grip, which is the downwardly extending part of the body (110), manufactured in accordance with the structure of the hand to ensure proper grip. The rear protrusion (117) shown in FIG. 2 is formed on the inner surface of the grip, close to the user, in order to prevent the magazine from swinging while it is inserted in the body (110). The front protrusion (118) shown in FIG. 3 is formed on the inner surface of the grip, opposite the rear protrusion (117), in order to prevent the magazine from swinging while it is inserted in the body (110). The rear protrusion (117) and front protrusion (118) formed within said grip occupy the space created due to the arrangement of the bullets when the magazine with a capacity of 15 bullets of 9 mm is inserted into the body (110), preventing the magazine from moving/swinging within the body (110). Said rear protrusion (117) and front protrusion (118) allow the magazine to fit properly into the well in the grip, thus eliminating issues such as jamming and ejection before and after firing.

In a preferred embodiment of the invention, two parallel rear protrusions (117) are provided on the inner surface of the grip.

In a preferred embodiment of the invention, the rear protrusion (117) and the front protrusion (118) begin at the bottom of the body (110) and extend upward along the grip up to the length of the magazine.

The invention claimed is:

1. A pistol comprising:

a body having a grip extending therefrom, the grip adapted to receive a magazine therein;

a trigger guard integral with or connected to said body in an area in front of the grip;

a trigger movably positioned interior of said trigger guard;

a trigger pin slot positioned at an upper portion of said trigger guard at a side of said body so as to allow said trigger to be fixed and operated within said trigger guard;

a magazine latch slot positioned at one area where the grip and said trigger guard meet, said magazine latch slot adapted to hold the magazine within said body;

a picatinny rail positioned at a front portion of said body;

a barrel lock slot positioned between the grip and said picatinny rail on a side of said body, said barrel lock slot adapted to lock a barrel of the pistol within said body, a trigger group collector slot positioned on a rear part of the grip facing a user, said trigger group collector slot fixing a trigger to said body;

a rear protrusion integrally formed on an inner surface of the grip; and a front protrusion integrally formed on the inner surface of the grip opposite to said rear protrusion, said rear protrusion and said front protrusion adapted to bear against the magazine so as to prevent the magazine from shifting positions within the grip.

2. The pistol of claim 1, wherein said rear protrusion comprises a pair of parallel protrusions on the inner surface of the grip.

* * * * *